US005798474A

United States Patent [19]

Rogers et al.

[11] Patent Number: 5,798,474

[45] Date of Patent: Aug. 25, 1998

[54] MUZZLE BLAST DEFLECTOR

[76] Inventors: Ernest E. Rogers, 1735 E. Cherokee, Pleasant Grove, Utah 84062; Blaine A. Frandsen, 1240 Riverview Dr., Garland, Utah 84312; Steven W. Soffe, 114 S. 1250 E., Logan, Utah 84321

[21] Appl. No.: 773,372

[22] Filed: Dec. 26, 1996

[51] Int. Cl.[6] ..... F41A 21/28; F41A 21/36

[52] U.S. Cl. ..... 89/14.05; 89/14.3; 42/76.01

[58] Field of Search ..... 89/14.05, 14.3, 89/14.4, 16; 42/76.01, 76.02

[56] References Cited

U.S. PATENT DOCUMENTS

| | | | |
|---|---|---|---|
| 1,315,504 | 9/1919 | Humm | 89/14.3 |
| 1,363,058 | 12/1920 | Schneider | 89/14.3 |
| 2,150,161 | 3/1939 | Green | 89/14.3 |
| 2,503,491 | 4/1950 | Janz . | |
| 3,340,769 | 9/1967 | Waser | 89/14.4 |
| 3,399,597 | 9/1968 | Perrine | 89/14.4 |
| 3,611,611 | 10/1971 | Quinney | 42/75.02 |
| 3,670,622 | 6/1972 | Bryant et al. . | |
| 3,707,899 | 1/1973 | Perrine | 89/14.3 |
| 3,714,727 | 2/1973 | Iino | 42/79 |
| 3,776,093 | 12/1973 | Leverance et al. . | |
| 3,858,481 | 1/1975 | Elliot | 89/14.3 |
| 4,291,610 | 9/1981 | Waiser | 89/14.4 |
| 4,307,652 | 12/1981 | Witt et al. | 89/14.3 |
| 4,322,999 | 4/1982 | Aston | 89/14.3 |
| 4,374,484 | 2/1983 | Bekker et al. | 89/14.3 |
| 4,501,189 | 2/1985 | Brandl et al. | 89/14.4 |
| 4,527,348 | 7/1985 | Brennan | 42/78 |
| 4,879,942 | 11/1989 | Cave | 89/14.3 |
| 4,930,396 | 6/1990 | Johnson | 89/14.3 |
| 4,942,801 | 7/1990 | Schuemann | 89/14.3 |
| 5,020,416 | 6/1991 | Tripp | 89/14.3 |
| 5,036,747 | 8/1991 | McClain, III | 89/14.3 |
| 5,063,827 | 11/1991 | Williamson | 89/14.3 |
| 5,092,223 | 3/1992 | Hudson | 89/14.3 |
| 5,105,717 | 4/1992 | Pond | 89/14.3 |
| 5,123,329 | 6/1992 | Irwin | 89/14.3 |
| 5,136,923 | 8/1992 | Walsh, Jr. | 89/14.4 |

FOREIGN PATENT DOCUMENTS

| | | | |
|---|---|---|---|
| 384948 | 4/1908 | France . | |
| 510683 | 12/1920 | France . | |
| 744646 | 4/1933 | France . | |
| 812261 | 5/1937 | France | 89/14.3 |
| 863025 | 3/1941 | France . | |
| 2407451 | 5/1979 | France | 89/14.4 |
| 27 12 458 | 9/1978 | Germany . | |
| 87 01929 U | 7/1988 | Germany . | |
| 104199 | 2/1917 | United Kingdom . | |
| 230502 | 10/1925 | United Kingdom | 89/14.3 |

*Primary Examiner*—Stephen M. Johnson
*Attorney, Agent, or Firm*—Trask Britt & Rossa

[57] ABSTRACT

The blast deflector may be used with a barrel and with a firearm. The blast deflector threads onto the end of a barrel of the type that has an outer tube and an inner tube defining a chamber thereinbetween. The blast deflector provides for a sealing connection between the outer tube and the inner tube. The blast deflector has a plurality of channels radially spaced around a central passage. Each of the channels is sized to define an axially aligned member that extends inwardly but is spaced away from the central passage to define a receiving chamber. The receiving chamber has length of about 2 to about 4 times the diameter of the projectile. The propellant gases enter the receiving chamber and are directed out through the transverse channels rearwardly which are formed at an angle of about 60° relative to the axis of the central passage.

48 Claims, 3 Drawing Sheets

MUZZLE BLAST DEFLECTOR

BACKGROUND OF THE INVENTION

1. Field of the Invention

The present invention relates to firearms with muzzle blast deflecting structure including muzzle blast deflecting devices. More particularly the invention relates to a muzzle blast deflector for a gun barrel of the type having a vent chamber.

2. State of the Art

Upon discharge or firing of a firearm such as a rifle, a projectile is typically forced out of a cartridge by propellant. The burned propellant is an expanding composition of gasses that urge the projectile through the barrel and exit the barrel behind the projectile. The exiting gases interact with the surrounding air and create what may be said to be a muzzle blast. A loud noise or report is typically associated with the muzzle blast. A flash of light may also be associated with the muzzle blast.

In darkness, the muzzle blast upon discharge of the firearm may be quite bright and temporarily impair the vision of the user as well as others in the immediate vicinity. Further the muzzle blast may disclose the location of the person discharging the firearm both visually and audibly when such disclosure may not be desired. Further the associated recoil may cause discomfort and may even affect the user's ability to accurately make a second shot in rapid succession to the first.

Gun barrels and firearms may employ a number of different devices to improve performance and to deal with one or more of the consequences of the muzzle blast. For example, muzzle brakes may be used to reduce recoil; ports may be provided to reduce recoil and muzzle jump; silencers may be added to reduce the report; and other devices may be provided to adjust the weight characteristics of the barrel.

More recently, barrels and barrel attachments have had a number of different benefits. For example, U.S. Pat. No. 5,279,200 (Rose) discloses a device that combines a muzzle brake to reduce recoil with a weight adjustment or ballistic optimizer to improve accuracy. U.S. Pat. No. 5,355,765 (Rogers) discloses a barrel that reduces muzzle blast to enhance accuracy.

In prior art devices, the blast deflection is typically directed outwardly from the weapon but not rearwardly toward the user. For example U.S. Pat. No. 5,063,827 (Williamson) shows deflection outwardly and forwardly from the muzzle area.

Similarly, U.S. Pat. No. 4,307,652 (Witt et al.) shows structure to direct muzzle blast in a forward direction. U.S. Pat. No. 5,036,747 (McClain) shows structure in which the propellant gases at the muzzle are first directed in a forwardly direction before interacting with a cup-like device that redirects the gas in a generally rearward direction. U.S. Pat. No. 4,879,942 (Cave) also shows a muzzle brake device in which the propellant gases are directed in an outwardly and forwardly direction. U.S. Pat. No. 4,930,396 (Johnson) shows muzzle gasses being directed outwardly from the muzzle area of the weapon.

U.S. Pat. No. 5,020,416 (Tripp) shows a muzzle brake to reduce recoil and muzzle jump. It has slots to vent gases upwardly or upwardly and rearwardly.

U.S. Pat. No. 3,714,727 (Iino) shows the use of gas jets to release propellant gases in an upward direction from the muzzle area of the weapon. U.S. Pat. No. 3,707,899 (Perrine) shows muzzle gasses being released in an outwardly and forward direction. Similarly, U.S. Pat. No. 4,322,999 (Aston) shows propellant being exhausted in an outwardly and forwardly direction.

Directing gasses or propellant in a rearward direction is believed to have been undesirable because the gases or blast is being directed toward rather than away from the user. The gases may cause some discomfort. In some cases the gases cause an undesirable increase in sound levels perceived by the user.

A firearm and a device for use with a barrel of a firearm to reduce recoil and to reduce the effects of muzzle blast is desired.

SUMMARY OF THE INVENTION

A firearm has a receiver for receiving a cartridge containing a projectile such as a bullet. The receiver is configured for activating the cartridge to discharge the projectile from the receiver. More particularly the receiver has a trigger mechanism and a breech portion configured to receive the cartridge. Handle means are connected to the receiver means for grasping by a user. A barrel is connected to the receiver and more particularly to the breech to receive the projectile upon discharge.

The barrel has a muzzle end through which the projectile exits or is discharged. The barrel has a bore between the muzzle and breech for guiding the projectile. The barrel includes an inner tube defining a bore with a longitudinal axis. The inner tube has an aperture formed in its wall proximate to and spaced inwardly from the muzzle end. The barrel also has an outer tube positioned over the inner tube to form a chamber in fluid communication with the aperture in the wall to receive propellant gas therefrom after the projectile has substantially achieved its exit velocity. The outer chamber preferably has a muzzle end proximate the muzzle end of the barrel.

A blast deflector for deflecting the muzzle blast upon discharge of the projectile (after firing or activation) is attached to the muzzle end of the barrel. The blast deflector has an attachment end for attachment to the muzzle end of the barrel and a distal end for discharging the projectile. The projectile passes through an opening in a face of the blast deflector the diameter of which is preferably selected to be from about two to about four times the diameter of the projectile. The blast deflector has a central passage for alignment with the bore of the barrel and for transmission of the projectile from the attachment end to the distal end.

The blast deflector also has a sidewall with a plurality of transverse channels formed therein. Each of the transverse channels is spaced apart in the sidewall and may be said to be radially or circumferentially positioned about the central passage and is in communication with the central passage through the sidewall. The attachment end, the distal end of the blast deflector, and deflector sidewall with the transverse channels all in combination define a receiving chamber which is preferably in length about two to about four times the diameter of the projectile. Attachment means is mechanically associated with the blast deflector and the barrel for attaching the attachment end of the blast deflector to the muzzle end of the barrel.

In a preferred configuration, two adjacent channels of the plurality of transverse channels are formed in the sidewall and sized to define a support member with a portion extending inwardly toward and spaced from the central passage to define a receiving chamber. The central passage has an axis. Each transverse channel also has an axis. The axis of each transverse channel of the plurality of transverse channels extends rearwardly at an angle from about 50° to about 70° from the axis of the central passage.

Each of the plurality of transverse channels has an axial length and a width. The length preferably exceeds the width. The support members also desirably extend generally in axial alignment with the axis of the central passage. That is the axial length or width is generally in alignment with the central axis.

In a preferred configuration, each transverse channel is preferably substantially rectilinear in projection.

In an alternate configuration, each transverse channel of the plurality of transverse channels is sized so that each pair of adjacent transverse channels defines a member with a ridge in which the ridge is spaced from the central passage a preselected distance.

In a preferred arrangement the attaching means includes first and second threads. The first threads are formed at the muzzle end of the barrel means to interconnect and co-act with second threads formed in the blast deflector.

There are preferably six transverse channels radially spaced about the central passage each of which extends rearwardly at an angle of 60° from the axis of the central passage.

The attaching means of a blast deflector is preferably configured to associate with both the muzzle end of the inner tube and the muzzle end of the outer tube. The attaching means desirably includes sealing means for effecting a sealing connection between the outer tube and the inner tube.

In a preferred configuration, the sealing means includes a distal surface formed at the muzzle end of the outer tube. The distal surface is configured to flushly contact a sealing surface of the blast deflector. Desirably, the distal surface is formed to extend rearwardly toward the breech end. More preferably, the distal surface extends rearwardly at an angle from about 50° to about 70°, and most preferably at an angle of about 60°.

The attachment means and sealing means may also include first thread structure formed at the muzzle end of the inner tube and second thread structure formed in the blast deflector for threaded engagement therebetween. The first thread structure and the second thread structure effect not only a sealing connection but also a mechanical association.

The sealing means may also include an O-ring seal between the outer tube and positioned between the outer tube and the blast deflector to effect a sealing association therebetween.

In an alternative arrangement, a blast deflector may also include support members that are generally shaped with a ridge in which the ridge is spaced from the central passage at a preselected distance to further define the receiving chamber. That is, the size of each transverse adjacent channel is selected so that upon formation by drilling or milling into the sidewall of the blast deflector, the support member is defined with a tip or ridge extending in general axial alignment with the central passage. The support member in one embodiment may be generally pie-shaped or triangular in cross section.

It may be understood that the invention further includes a barrel system consisting of a barrel and a blast deflector similar to the blast deflector as hereinbefore set forth.

A separate blast deflector as generally defined hereinbefore may also be provided apart from the barrel and apart from a firearm.

DETAILED DESCRIPTION OF THE ILLUSTRATED EMBODIMENT

Figure 1:
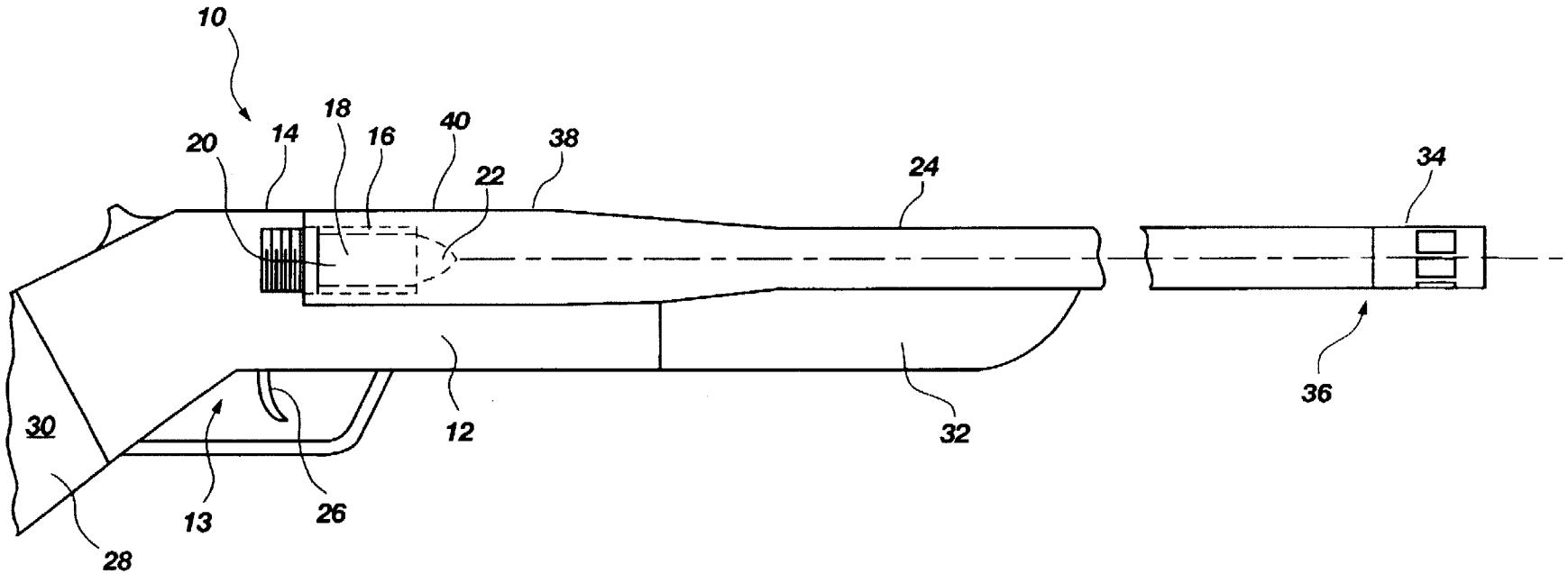
FIG. 1 is a simplified side view of a firearm of the present invention.

The firearm illustrated in FIG. 1 is generally configured as a rifle. It has a receiver 12 with a trigger mechanism 13 and with a breech area 14. A chamber 16 is formed in the breech area 14 to receive a cartridge 18. The cartridge is configured to have a casing 20 along with a bullet 22.

The cartridge 18, as illustrated, is that of a typical or conventional "bullet" in which the casing 20 contains a propellant such as powder and similar materials which burn and generate gases upon firing. Firing is in effect the detonation or explosion of the powder to discharge the bullet 22. Upon firing the bullet 22 is a projectile that leaves the chamber 16 and is propelled through the barrel 24 in a conventional manner. The receiver 12 contains the trigger mechanism 13 which may be operated by a trigger 26 to, in turn, cause a firing pin (not shown) to strike the cartridge 18 to initiate the detonation or explosion.

The firearm 10 also includes handle means such as stock 28 which is configured for grasping by a user. The stock 28 may include a portion 30 for positioning proximate the shoulder of a user and another portion 32 positioned for grasping by the hand of the user.

The firearm 10 shown in FIG. 1 is that generally of a rifle as hereinbefore noted. The firearm involved may also include various other kinds of weapons such as, for example, handguns and automatic weapons and even large guns such as cannons and large rifles that are not hand held but rather supported by support structures. In some cases, the propellant may be separate from the bullet and not in a casing.

The firearm 10 of FIG. 1, as noted, has a barrel 24 interconnected to the receiver 12 and more particularly to the chamber 16 in the breech area 14 to receive the projectile which is the bullet 22. The bullet 22 proceeds through the barrel and through a blast deflector 34 positioned at the muzzle end 36 of the barrel.

Figure 2:
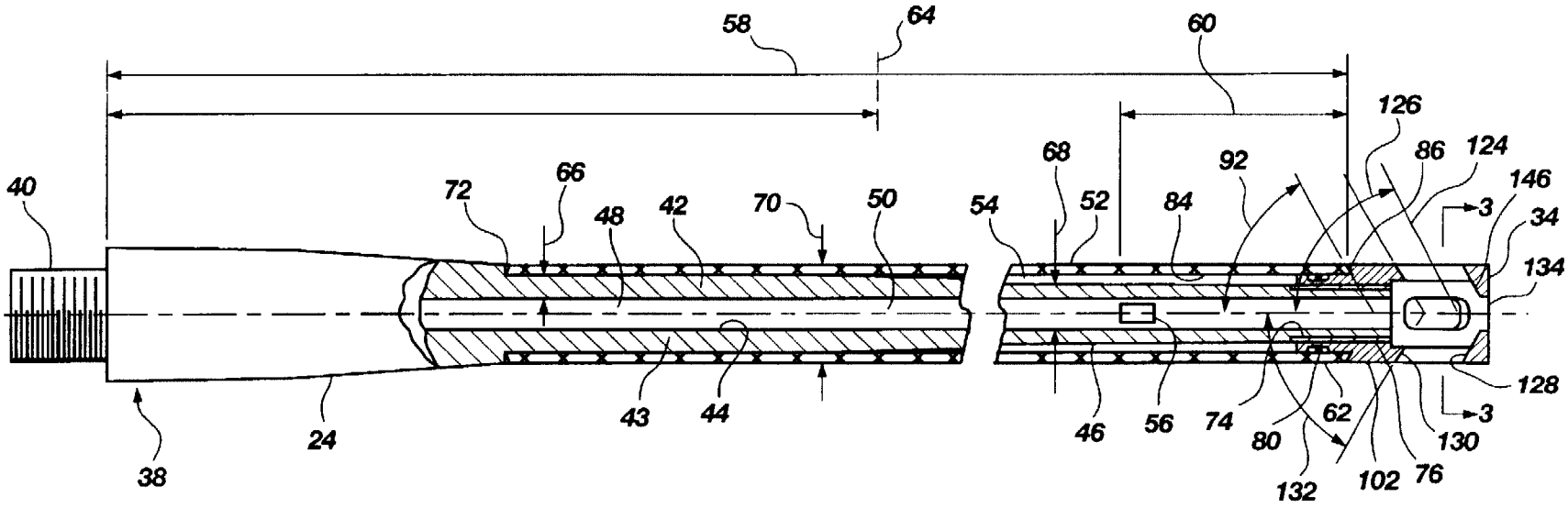
FIG. 2 is a simplified longitudinal cross-sectional cutaway view of a barrel and a blast deflector of the present invention.

As better seen in FIG. 2, the barrel 24 is generally of the type illustrated and described in U.S. Pat. No. 5,355,765 (Rogers), the disclosure of which is incorporated herein by reference. The barrel 24 has a receiver end 58 with a threaded connector 40 configured for connection to receiver means, such as the receiver 12, and even more particularly, the chamber 16 in the breech area 14 of the receiver 12.

The barrel 24 has an inner tube 42 with a sidewall 43 having an inner surface 44 and an outer surface 46. The inner tube 42 defines a bore 48 which has a central axis 50. The barrel 24 also has an outer tube 52 which is positioned over the inner tube 42 to define a chamber 54.

A plurality of apertures such as aperture 56 are formed in the sidewall 43. The apertures 56 are positioned along the length 58 of the barrel 24 a distance 60 spaced inwardly from the muzzle end 62 of the barrel 24 selected so that the propellant may enter the chamber 54 after the projectile such as bullet 22 substantially achieves its exit velocity.

As known, upon activation (firing) of the cartridge 18, the powder and other materials therein burn creating gases that urge the projectile such as bullet 22 through the barrel 24 and accelerate it along the length 58 of the barrel. As disclosed in U.S. Pat. No. 5,355,765, typically more than 80% of the final velocity of the projectile is achieved as the projectile reaches the midpoint 64 of travel in the barrel 24. At 90% of travel it is believed that 98% of the muzzle velocity has been achieved. That is, a projectile, such as bullet 22, accelerates quite rapidly from the cartridge to the midpoint 64 of the barrel 24. The apertures, such as apertures 56, are positioned through the wall 43 of the inner tube 42 to communicate with the chamber 54 between the midpoint 64 and the muzzle end 62 so that the projectile, such as bullet 22, will have achieved at least 80% of its muzzle velocity before the propellant gases, which are urging the bullet into the barrel, are able to enter the chamber 54. As illustrated in FIG. 2, the apertures 56 are positioned proximate the muzzle end 62 of the barrel 24 at a distance 60 selected so that the projectile 22 has achieved preferably at least 85% or more of its muzzle velocity. As such, it may be said that it has achieved substantially its exit velocity.

It may be noted in FIG. 2, that the outer surface 46 of the inner tube 42 tapers from a first thickness 66 to a second thickness 68. The outer tube 52 is here shown with cross-sectional lines generally in the form of X's to facilitate understanding and avoid unnecessary conflicting cross-sectional hatching. The outer tube 52 is here shown to have a generally constant outside diameter 70. As a result, the chamber 54 increases in dimension between the midpoint 64 and the muzzle end 62. The outer tube 52 is connected to the inner tube proximate the breech end 38 by welding 72 the outer tube 52 to the inner tube 42, by providing for a threaded connection or by other means of mechanical association to provide a sealed relationship therebetween.

As also seen in FIG. 2, the blast deflector 34 is shown connected to the muzzle end 62 of the barrel 24. Attaching means are provided for attaching the blast deflector 34 to the barrel 24. As here shown, the attaching means includes a system of threads to provide for a mechanical connection. More specifically, the inner tube 42 of the barrel 24 has first threads 74 formed thereabout to interact with second threads 76 formed in the blast deflector 34. The first threads 74 and second threads 76 provide for a secure mechanical connection and also act as a seal to restrict the transmission of propellant there past. That is, as the projectile proceeds down the bore 48 and passes the apertures 56, some propellant gases will vent into the chamber 54. To prevent further escape of propellant from the chamber 54 past the blast deflector, the threads 74 and 76 function as a sealing mechanism. Threads may also be formed in the outer tube 52; and the blast deflector reconfigured for threadedly connecting thereto.

It may also be seen that sealing means are provided in addition to the threads. That is, an O-ring groove 78 (FIG. 4) along with an O-ring 80 are provided proximate the attachment end 82 of the blast deflector 34. The O-ring is positioned inside to provide a sealing relationship with the interior surface 84 of the outer tube 52. An O-ring seal may also be provided to effect a seal between the blast deflector and the inner tube 42.

The sealing means may also include a sealing surface 86 formed at the end of the outer tube 52. The sealing surface 86 is configured to mate or flushly contact a sealing surface 88 of the blast deflector. That is, the sealing surface 86 of the outer tube 52 and the sealing surface 88 of the blast deflector are configured to snugly abut to restrict the passage of any propellant that may be able to leak past the O-ring seal effected by the O-ring 80 positioned in the O-ring groove 78.

As can be seen in FIG. 2, the sealing surface 86 of the outer tube 52 and the sealing surface 88 of the blast deflector 34 are angulated to extend toward the attachment end 82 of the blast deflector 34 and towards the breech end 38 of the barrel 24. As can be seen, the sealing surface 86 of the outer tube 52 extends rearward at an angle which may extend from about 45° to about 70° and is preferably at an angle 92 of 60° as measured from the axis 50. Of course, the corresponding surface 88 of the blast deflector 34 also extends at an angle 94 from about 45° to about 70° and preferably 60° as measured from the central axis 96 of the central passage 98.

It can be seen that the central axis 96 of the blast deflector 34 is positioned to be in line with the central axis 50 of the barrel 24. The central passage 98 is sized to receive the projectile, such as bullet 22, and in this particular embodiment to also engage the muzzle end of the barrel 24. The projectile then passes into the receiving chamber 100 and then through the discharge opening 101.

The receiving chamber 100 may be said to be generally cylindrical and is the space interior of the supports 136–141. The receiving chamber has a length 131 which is here selected to extend from about 2 to about 4 times the diameter 23 of the projectile such as bullet 22 and preferably from about 2.5 times to about 3 times the diameter 23 of the projectile. In the illustrated embodiment, the length 131 is 2 and one-half times the diameter 23 of the projectile. The chamber 100 has a diameter 143 which is selected to be no less than the outside diameter 97 of the threads 96 and is preferably the diameter of the outside threads plus a distance 133 from about 1/64 of an inch to about 1/16 of an inch for the illustrated barrel. That is, the threads 96 have an inside diameter 99 and an outside diameter 97. The diameter 143 of the chamber 100 is preferably as large as possible while providing for supports 136–141 of sufficient strength to preclude bending, denting flexing or the like, in use.

The blast deflector 34 also has an outside diameter 145 which may extend from about 2.5 to about 4 times the diameter of the projectile and is preferably 3 times the diameter 23 of the projectile.

A plurality of transverse channels are formed to extend through the sidewall 102 of the blast deflector 34. As better seen in FIG. 3, six transverse channels 104–109 are formed. The number of channels formed may vary as desired so long as the supports such as supports 136–141 are strong enough to support the muzzle end and otherwise sturdy enough so the user cannot bend or break the muzzle deflector 34 in use.

Figure 4:
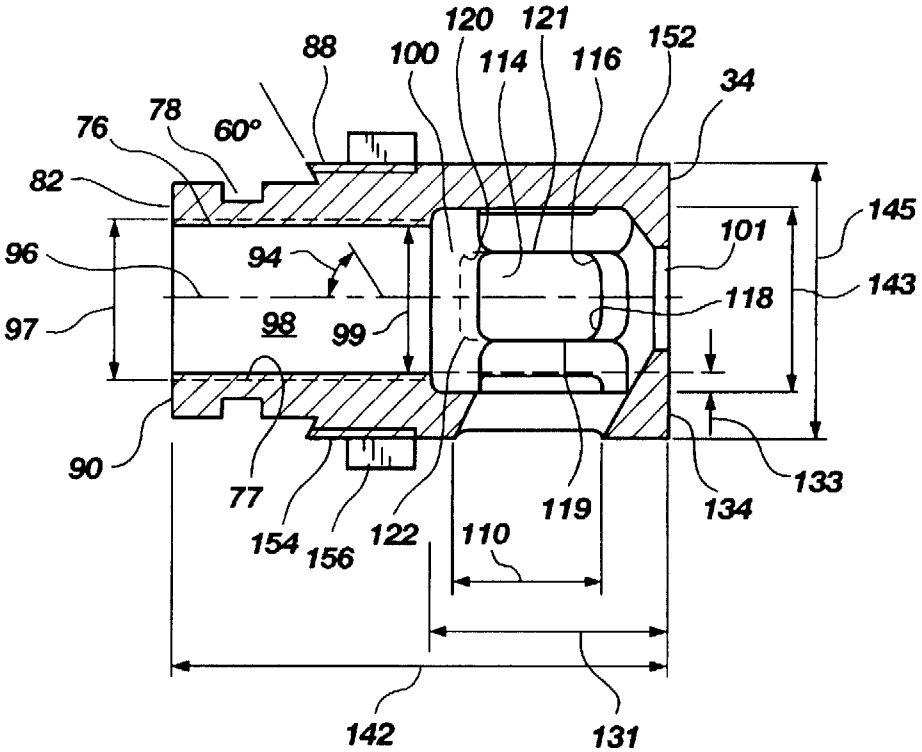
FIG. 4 is a cross-section of the blast deflector of the present invention taken at the broken section line 4—4 of FIG. 3.

In this embodiment, the transverse channels 104–109 are each formed to have an axial length 110 and width 112. The axial length 110 is typically larger than the width 112 to create an opening 114 that may be said to be generally rectilinear in projection. As can be seen in FIG. 4, the opening is said to be generally rectilinear because it generally parallel sides with rounded corners 116, 118, 120 and 122. The sides 119 and 121 are generally oriented to be in axial alignment with the central axis 96.

The transverse channels 104–109 may be formed to be circular in cross section and cylindrical in shape, or in other geometric shapes as desired. Notably the transverse channels are formed to have a collective or total cross section equal to or greater than the cross section of the projectile such as bullet 22. It is believed that the lower pressure of the propellant at the muzzle end when using a barrel of the type shown in FIG. 2 leads to a lower blast and report. However, with a blast deflector of the type herein disclosed significant further reductions in the report, recoil and flash can be obtained.

Each transverse channel 104–109 has an axis 124 which is here shown to pass through the axis 96 of the blast deflector 34. The transverse channels 104–109 are formed through the sidewall 102 of the blast deflector 34 to extend toward the attachment end 90 of the blast deflector 34. More particularly, the transverse channels 104–109 extend at an angle 126 (FIG. 2) which is selected to be from about 50° to about 70° and is preferably 60° between the axis 124 of the transverse channels 104–109 and the central axis 96 of the central passage 98. Similarly, the sidewalls of each of the transverse channels 104–109 such as sidewalls 128 and 130 also extend toward the attachment end 90 of the blast deflector 34 at an angle 132 which may be from about 50° to about 70° and is preferably 60°.

Notably, some transverse channels may extend normally or even forwardly toward the distal end of the blast deflector. That is, the transverse channels may be formed in a pattern, some extending toward the attachment end, some toward the distal end and others normally from the central axis.

The blast deflector 34, as stated, has a central passage 98 which extends from the attachment end 82 to a distal end 134. The central passage 98 is sized to receive the inner tube 42 thereinto as part of the threaded engagement as illustrated. The central passage 98 extends to the muzzle end 134 to provide for a discharge opening 101 through which the projectile, such as bullet 22, passes. It can be seen that the propellant, such as propellant gases that continue to urge the projectile outwardly through the barrel, can be diverted and are diverted through the transverse channels in an outwardly direction as discussed more fully hereinafter.

Figure 3:
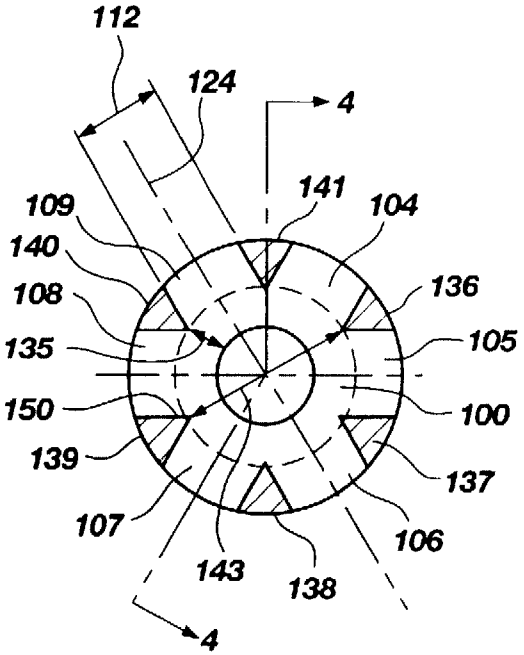
FIG. 3 is a cross-sectional view of the blast deflector of the present invention taken at section 3—3.

Each of the transverse channels 104–109 is formed by boring through the sidewall 102 of the blast deflector 34 or by forming the channels in a casting or molding process. The cross section and more specifically the diameter or the width 112 of each transverse channel is selected to remove enough sidewall material so that sidewall material will not extend to the central passage 98. Thus, as depicted in FIG. 3, the width 112 and the number of transverse channels is selected so that a plurality of supports 136–141 are formed. That is, two adjacent transverse channels, such as channels 104 and 105, define a support 136 which is a continuation of the wall 102 along the length 142 of the blast deflector 34.

The supports, such as support 136 in this embodiment, extend generally in axial alignment with the central axis 96 of the central passage 98. If the transverse channels are in some other shape, the supports will not necessarily have a length. For example, if the transverse channels are circular in section, the supports will be arcuate and not generally said to have a length.

The illustrated transverse channels and, more particularly, the supports 136–141 along with the distal end and attachment end, define the receiving chamber 100. The receiving chamber 100 receives the projectile which passes therethrough en route from the attachment end 90 to the muzzle end 134. Upon passage of the projectile through the chamber 100, the propellants behind the projectile enter a larger volume thereby diminishing in pressure. The propellants also contact the interior surface 146 and, in turn, deflect radially outwardly toward the transverse channels. Since the area of the transverse channels is greater than that of the discharge opening 101, the propellants will experience less resistance and in turn proceed into the transverse channels for exhausting in an outward and, in this embodiment, in a generally rearward direction.

The supports 136–141, shown in FIG. 3, are here shown to be generally pie-shaped or generally triangular in cross-section. The tip or ridge 150 of each of the pie-shaped supports 136–141 extends toward the central passage 98 but is spaced outwardly therefrom. The central passage 98 has a diameter 143 which is defined to be no less than the outer diameter 97 of the second threads 76. That is, the inner portion 77 of the second threads 76 is the innermost diameter of the chamber 100. In this embodiment, the chamber 100 has a diameter 143 that is somewhat larger and is selected to be about 1/64 of an inch to about 1/16 of an inch larger than the outer diameter 97 of the second threads 76.

It can be seen that the transverse channels 104–109 can be sized in width 112 so that the tips 150 of the supports 136–141 are not sharp and so that in cross-section the geometric configuration of the supports may be polygonal with an inwardly facing surface that may have any desired shape or configuration. As seen in FIG. 4, weight 156 is positioned for movement toward the muzzle end 134 and toward the attachment end 82 as desired to affect the balance of the overall gun barrel 124 and, in turn, impact on the frequency of vibrations of the barrel upon discharge or activation of the cartridge. In turn, ballistic optimization may be effected for different categories of bullets 22. The outer surface 152 may have various scribe marks or notches for alignment with a notch or scribe associated with the weight 156. Thus, adjustments can be made for different types of bullets 22, as desired by the user.

In operation, the blast deflector 34 is positioned at the muzzle end 62 of the barrel 24 to effect a sealing connection between the outer tube 52 and inner tube 42 and to divert the blast or deflect the blast of the exiting propellant outwardly and rearwardly in a manner to reduce recoil and to reduce the noise level. Indeed, it has been determined that the noise level can be reduced significantly; and it has been determined in some situations the reduction can be as much as 10 decibels.

It should be understood that the embodiments herein described are merely illustrative of the principles of the invention. Reference herein to the details of the illustrated embodiments is not intended to limit the scope of the claims which themselves recite those features regarded as essential the invention.

What is claimed is:

1. A firearm comprising:

receiver means for receiving a propellant and a projectile and for activating said propellant to discharge said projectile therefrom;

support means connected to said receiver means for supporting said receiver means;

barrel means for communicating said projectile, said barrel means having an inner tube defining a bore, an outer tube positioned about said inner tube to define a sealed chamber there between and aperture structure to communicate propellant from said bore to said sealed chamber, said barrel means having a receiver end connected to said receiver means to receive said projectile into said bore and a muzzle end for discharging said projectile from said bore;

a blast deflector for deflecting a muzzle blast upon activation of said propellant and discharge of said projectile, said blast deflector having an attachment end configured for attachment to the muzzle end of said barrel means and a distal end for discharging said projectile therefrom, said blast deflector having a central passage for alignment with said bore of said barrel means and for transmission of said projectile from said attachment end to said distal end, and said blast deflector having a sidewall with a plurality of transverse channels formed therein and spaced radially about said central passage to be in communication through said sidewall from said central passage, through said sidewall to exterior said barrel means; and attaching means mechanically associated with said blast deflector and said barrel means for attaching the attachment end of said blast deflector to said muzzle end of said barrel means.

2. The firearm of claim 1, further including a receiving chamber formed in said blast deflector between said attachment end and said distal end with said central passage passing therethrough.

3. The firearm of claim 2, wherein said central passage has an axis and wherein each transverse channel of said plurality of transverse channels has an axis, and wherein the axis of at least one transverse channel of said plurality of transverse channels extends rearwardly at an angle from about 50 degrees to about 70 degrees between the axis of said central passage and the axis of each of said plurality of transverse channel.

4. The firearm of claim 3 wherein said plurality of transverse channels is six transverse channels radially spaced about said central passage, and wherein the angle between the axis of each of said transverse channels and said central passage is 60 degrees.

5. The firearm of claim 2, wherein each transverse channel of said plurality of transverse channels has a length and a width, and wherein the said length exceeds the said width and wherein each pair of adjacent traverse channels define a support member which extends generally in axial alignment with said axis of said central passage.

6. The firearm of claim 5, wherein each transverse channel of said plurality of transverse channels is substantially rectilinear in projection.

7. The firearm of claim 2, wherein said projectile has a diameter and wherein said receiving chamber is formed to have a length from about two times to about four times the diameter of said projectile.

8. The firearm of claim 7, wherein said length of said receiving chamber is about two and one-half times the diameter of said projectile.

9. The firearm of claim 2, wherein said projectile has a diameter and wherein said blast deflector is circular in projection with a front surface having a diameter from about two times to about four times the diameter of said projectile.

10. The firearm of claim 1, wherein two adjacent transverse channels of said plurality of transverse channels are formed in said sidewall and sized to define a support member with a portion extending inwardly toward and spaced from said central passage.

11. The firearm of claim 10, wherein each transverse channel of said plurality of transverse channels is sized so that each pair of adjacent transverse channels defines a support member with a ridge in which said ridge is spaced away from said central passage.

12. The firearm of claim 1, further including sealing means mechanically associated with said blast deflector and said barrel means for effecting a seal to inhibit the transmission of propellant from said chamber.

13. The firearm of claim 12, wherein said outer tube has a distal end wherein said sealing means includes O-ring structure associated with said blast deflector to effect a seal proximate the distal end of said outer tube.

14. The firearm of claim 13, wherein said sealing means includes sealing surfaces formed at said distal end of said outer tube and on said blast deflector and positioned to snugly mate.

15. The firearm of claim 12, wherein said attaching means includes thread structure for threadedly engaging the blast deflector and said muzzle end of said barrel means, and wherein said sealing means also includes said thread structure.

16. The firearm of claim 1, wherein said attaching means includes coacting first and second threads said first threads being formed at said muzzle end of said barrel means to interconnect with said second threads formed in said blast deflector.

17. For transmitting a projectile, a barrel system comprising:

a barrel for communicating a projectile, said barrel having a breech end for connecting to the breech of a firearm to receive a projectile therefrom and having a muzzle end for discharging said projectile with a bore formed for the transmission of said projectile from said breech end to said muzzle end, said barrel including:

an inner tube with a longitudinal axis and a wall defining said bore, said inner tube having an aperture formed in said wall proximate to and spaced inwardly from said muzzle end, and an outer tube positioned over said inner tube to form a sealed chamber in fluid communication with said aperture in said wall to receive propellant therefrom, said aperture being positioned in said wall to receive said propellant after said projectile achieves substantially the exit velocity and to return said propellant to said barrel;

a blast deflector for connection to the muzzle end of said barrel, said blast deflector having an attachment end for attaching to said muzzle end of said barrel and a distal end with a central passage therein between, said blast deflector having a plurality of transverse channels to communicate gas to exterior said blast deflector and said barrel; and attaching means for attaching said blast deflector to said barrel.

18. The barrel system of claim 17, wherein said blast deflector has a sidewall with said plurality of transverse channels formed therein and radially spaced about said central passage each sized and shaped to define a support member having a portion extending toward said central passage and spaced from said central passage to define a receiving chamber for receiving propellant after passage of said projectile, each of said transverse channels having an axis extending rearwardly toward said attachment end.

19. The barrel system of claim 17, wherein said outer tube has a muzzle end and said inner tube has a muzzle end positioned proximate the muzzle end of said outer tube, and wherein ;aid attaching means is configured to associate with both said muzzle end of said inner tube and the muzzle end of said outer tube, and wherein said barrel system further includes sealing means for effecting a sealing connection between the outer tube and the inner tube.

20. A blast deflector for deflecting the propellant exiting a barrel used for communicating a projectile advanced through a central bore in said barrel from a breech end to a muzzle end, said barrel having an inner tube defining a bore with an outer tube positioned there over to define a sealed chamber and with an aperture positioned to communicate propellant between said chamber and said bore, said blast deflector comprising:

a central body having an attachment end for attaching to the muzzle end of said barrel to receive said projectile therefrom and a distal end for discharging said projectile, said central body having a wall defining a central passage formed to communicate said projectile between said attachment end and said distal end;

a plurality of transverse channels formed in said wall each radially spaced from the adjacent transverse channels about said central passage and extending from said central passage to exterior said central body, said transverse channels being formed with each transverse channel and an adjacent transverse channel defining a support member that has a portion extending inwardly toward said central passage and spaced from said central passage to define a receiving chamber for receiving said propellant and directing said propellant into said transverse channels, said receiving chamber being sized to not contact said projectile; and attaching means mechanically associated with said central body at said attachment end for attaching said blast deflector to said muzzle end.

21. The blast deflector of claim 20, wherein said each of said plurality of transverse channels is formed to extend rearwardly at an angle from about 50 degrees to about 70 degrees.

22. The blast deflector of claim 20, wherein said transverse channels are generally rectilinear in projection with a length oriented in general alignment with said central passage.

23. The blast deflector of claim 22 wherein said attachment means includes first threads formed in said inner tube and second threads formed in said central body to threadedly engage said first threads.

24. The blast deflector of claim 20, wherein said support member is generally pie shaped in cross section.

25. The blast deflector of claim 24, wherein there are 6 transverse channels.

26. The blast deflector of claim 20 wherein said inner tube has a muzzle end and said outer tube has a muzzle end and wherein said blast deflector includes sealing means to effect a sealing connection with the muzzle end of said outer tube and the muzzle end of said inner tube to inhibit the transmission of propellant from said chamber.

27. The blast deflector of claim 26, wherein said sealing means includes a sealing surface formed at the muzzle end of said outer tube configured to abut a coacting sealing surface of said blast deflector.

28. The blast deflector of claim 27, wherein said sealing surface is a conical surface that angulates rearwardly at an angle from about 45 degrees to about 70 degrees relative to the axis of said central passage.

29. The blast deflector of claim 26, wherein said sealing means further includes O-ring structure associating with said blast deflector and includes said first and second threads of said attaching means.

30. The blast deflector of claim 20, wherein said projectile has a diameter and wherein said receiving chamber has a length selected to be from about two times to about four times the diameter of said projectile.

31. A firearm comprising:

receiver means for receiving a propellant and a projectile having a diameter and for activating said propellant to discharge said projectile therefrom;

support means connected to said receiver means for supporting said receiver means;

barrel means for communicating said projectile, said barrel means having an inner tube defining a bore, an outer tube positioned about said inner tube to define a chamber there between and aperture structure to communicate propellant from said bore to said chamber, said barrel means having a receiver end connected to said receiver means to receive said projectile into said bore and a muzzle end for discharging said projectile from said bore;

a blast deflector for deflecting a muzzle blast upon activation of said propellant and discharge of said projectile, said blast deflector having an attachment end configured for attachment to the muzzle end of said barrel means and a distal end for discharging said projectile therefrom, said blast deflector having a receiving chamber formed therein with a central passage there through for alignment with said bore of said barrel means and for transmission of said projectile from said attachment end to said distal end, said blast deflector having a sidewall with a plurality of transverse channels formed therein and spaced radially about said central passage to be in communication through said sidewall between said central passage and exterior said sidewall, and said receiving chamber having a length from about two times to about four times the diameter of said projectile; and attaching means mechanically associated with said blast deflector and said barrel means for attaching the attachment end of said blast deflector to said muzzle end of said barrel means.

32. A firearm comprising:

receiver means for receiving a propellant and a projectile having a diameter and for activating said propellant to discharge said projectile therefrom;

support means connected to said receiver means for supporting said receiver means;

barrel means for communicating said projectile, said barrel means having an inner tube defining a bore, an outer tube positioned about said inner tube to define a chamber there between and aperture structure to communicate propellant from said bore to said chamber, said barrel means having a receiver end connected to said receiver means to receive said projectile into said bore and a muzzle end for discharging said projectile from said bore;

a blast deflector for deflecting a muzzle blast upon activation of said propellant and discharge of said projectile, said blast deflector having an attachment end configured for attachment to the muzzle end of said barrel means and a distal end for discharging said projectile therefrom, said blast deflector having a receiving chamber formed therein with a central passage aligned with said bore of said barrel means and for transmission of said projectile from said attachment end to said distal end, said blast deflector having a sidewall with a plurality of transverse channels formed therein and spaced radially about said central passage to be in communication through said sidewall between said central passage and exterior said sidewall, said receiving chamber having a length of about two and one half times the diameter of said projectile; and attaching means mechanically associated with said blast deflector and said barrel means for attaching the attachment end of said blast deflector to said muzzle end of said barrel means.

33. A firearm comprising:

receiver means for receiving a propellant and a projectile and for activating said propellant to discharge said projectile therefrom;

support means connected to said receiver means for supporting said receiver means;

barrel means for guiding and communicating said projectile, said barrel means having an inner tube defining a bore, an outer tube positioned about said inner tube to define a chamber there between and aperture structure to communicate propellant from said bore to said chamber, said barrel means having a receiver end connected to said receiver means to receive said projectile into said bore and a muzzle end for discharging said projectile from said bore;

a blast deflector for deflecting a muzzle blast upon activation of said propellant and discharge of said projectile, said blast deflector having an attachment end configured for attachment to the muzzle end of said barrel means and a distal end for discharging said projectile therefrom, said blast deflector having a central passage for alignment with said bore of said barrel means and for transmission of said projectile from said attachment end to said distal end, and said blast deflector having a sidewall with a plurality of transverse channels formed therein and spaced radially about said central passage to be in communication through said sidewall between said central passage and exterior said sidewall;

attaching means mechanically associated with said blast deflector and said barrel means for attaching the attachment end of said blast deflector to said muzzle end of said barrel means; and sealing means mechanically associated with said blast deflector and said barrel means for effecting a seal to inhibit the transmission of propellant from said chamber, said sealing means including O-ring structure associated with said blast deflector to effect a seal proximate the distal end of said outer tube.

34. A firearm comprising:

receiver means for receiving a propellant and a projectile and for activating said propellant to discharge said projectile therefrom;

support means connected to said receiver means for supporting said receiver means;

barrel means for communicating said projectile, said barrel means having an inner tube defining a bore, an outer tube positioned about said inner tube to define a chamber there between and aperture structure to communicate propellant from said bore to said chamber, said barrel means having a receiver end connected to said receiver means to receive said projectile into said bore and a muzzle end for discharging said projectile from said bore;

a blast deflector for deflecting a muzzle blast upon activation of said propellant and discharge of said projectile, said blast deflector having an attachment end configured for attachment to the muzzle end of said barrel means and a distal end for discharging said projectile therefrom, said blast deflector having a central passage for alignment with said bore of said barrel means and for transmission of said projectile from said attachment end to said distal end, and said blast deflector having a sidewall with a plurality of transverse channels formed therein and spaced radially about said central passage to be in communication through said sidewall between said central passage and exterior said sidewall;

attaching means mechanically associated with said blast deflector and said barrel means for attaching the attachment end of said blast deflector to said muzzle end of said barrel means; and sealing means mechanically associated with said blast deflector and said barrel means for effecting a seal to inhibit the transmission of propellant from said chamber, said sealing means including sealing surfaces formed at said distal end of said outer tube and on said blast deflector and positioned to snugly mate to effect a seal.

35. A blast deflector for deflecting the propellant exiting a barrel used for communicating a projectile advanced through a central bore in said barrel from a breech end to a muzzle end, said barrel having an inner tube defining a bore with an outer tube positioned there over to define a chamber and with an aperture positioned to communicate propellant between said chamber and said bore, said inner tube having a muzzle end and said outer tube having a muzzle end, said blast deflector comprising:

a central body having an attachment end for attaching to the muzzle end of said barrel to receive said projectile therefrom and a distal end for discharging said projectile, said central body having a wall defining a central passage formed to communicate said projectile between said attachment end and said distal end;

a plurality of transverse channels formed in said wall each radially spaced from the adjacent transverse channels about said central passage and extending from said central passage to exterior said central body;

attaching means mechanically associated with said central body at said attachment end for attaching said blast deflector to said muzzle end; and sealing means to effect a sealing connection with the muzzle end of said outer tube and the muzzle end of said inner tube to inhibit the transmission of propellant from said chamber, said sealing means including a sealing surface formed at the muzzle end of said outer tube configured to abut a coacting sealing surface of said blast deflector.

36. A blast deflector for deflecting the propellant exiting a barrel used for communicating a projectile advanced through a central bore in said barrel from a breech end to a muzzle end, said barrel having an inner tube defining a bore with an outer tube positioned there over to define a chamber and with an aperture positioned to communicate propellant between said chamber and said bore, said inner tube having a muzzle end and said outer tube having a muzzle end, said blast deflector comprising:

a central body having an attachment end for attaching to the muzzle end of said barrel to receive said projectile therefrom and a distal end for discharging said projectile, said central body having a wall defining a central passage formed to communicate said projectile between said attachment end and said distal end;

a plurality of transverse channels formed in said wall each radially spaced from the adjacent transverse channels about said central passage and extending from said central passage to exterior said central body;

attaching means mechanically associated with said central body at said attachment end for attaching said blast deflector to said muzzle end; and sealing means to effect a sealing connection with the muzzle end of said outer tube and the muzzle end of said inner tube to inhibit the transmission of propellant from said chamber, said sealing means including a sealing surface formed at the muzzle end of said outer tube configured to abut a coacting sealing surface of said blast deflector, said sealing surface formed at said muzzle end and said coacting sealing surface of said blast deflector each being a conical surface that angulates rearwardly at an angle from about 45 degrees to about 70 degrees relative to the axis of said central passage.

37. A blast deflector for deflecting the propellant exiting a barrel used for communicating a projectile advanced through a central bore in said barrel from a breech end to a muzzle end, said barrel having an inner tube defining a bore with an outer tube positioned there over to define a chamber and with an aperture positioned to communicate propellant between said chamber and said bore, said inner tube having a muzzle end and said outer tube having a muzzle end, said blast deflector comprising:

a central body having an attachment end for attaching to the muzzle end of said barrel to receive said projectile therefrom and a distal end for discharging said projectile, said central body having a wall defining a central passage formed to communicate said projectile between said attachment end and said distal end;

a plurality of transverse channels formed in said wall each radially spaced from the adjacent transverse channels about said central passage and extending from said central passage to exterior said central body;

attaching means mechanically associated with said central body at said attachment end for attaching said blast deflector to said muzzle end, said attaching means including first threads associated with said central body and second threads associated with said barrel; and sealing means to effect a sealing connection with the muzzle end of said outer tube and the muzzle end of said inner tube to inhibit the transmission of propellant from said chamber, said sealing means including O-ring structure associated with one of said barrel and said blast deflector and said sealing means including said first and second threads of said attaching means.

38. A blast deflector for deflecting the propellant exiting a barrel used for communicating a projectile having a diameter which projectile is advanced through a central bore in said barrel from a breech end to a muzzle end, said barrel having an inner tube defining a bore with an outer tube positioned there over to define a chamber and with an aperture positioned to communicate propellant between said chamber and said bore, said blast deflector comprising:

a central body having an attachment end for attaching to the muzzle end of said barrel to receive said projectile therefrom and a distal end for discharging said projectile, said central body having a wall defining a central passage formed to communicate said projectile between said attachment end and said distal end;

a plurality of transverse channels formed in said wall each radially spaced from the adjacent transverse channels about said central passage and extending from said central passage to exterior said central body, said transverse channels each being formed with each transverse channel and an adjacent transverse channel defining a support member that has a portion extending inwardly toward said central passage and spaced from said central passage to define a receiving chamber for receiving said propellant and for directing said propellant into said transverse channels, said receiving chamber having a length selected to be from about two times to about four times the diameter of said projectile; and attaching means mechanically associated with said central body at said attachment end for attaching said blast deflector to said muzzle end.

39. The blast deflector of claim 38, wherein said blast deflector has a front face with a diameter sized to be from about two times to about four times the diameter of said projectile.

40. For transmitting a projectile, a barrel system comprising:

a barrel having a breech end for connecting to the breech of a firearm and to receive a projectile therefrom, said barrel having a muzzle end for discharging said projectile with a bore formed for the transmission of said projectile from said breech end to said muzzle end, said barrel including:

an inner tube with a muzzle end and with a longitudinal axis and a wall defining said bore, said inner tube having an aperture formed in said wall proximate to and spaced inwardly from said muzzle end, and an outer tube with a muzzle end and positioned over said inner tube and proximate the muzzle end of said inner tube to form a chamber in fluid communication with said aperture in said wall to receive propellant therefrom, said aperture being positioned in said wall to receive said propellant after said projectile achieves substantially the exit velocity and to supply said propellant to said barrel from said chamber a blast deflector for connection to the muzzle end of said barrel, said blast deflector having an attachment end for attaching to said muzzle end of said barrel and a distal end with a central passage therein between;

attaching means for attaching said blast deflector to said barrel, said attaching means being configured to associate with both said muzzle end of said inner tube and the muzzle end of said outer tube; and sealing means for effecting a sealing connection between the outer tube and the inner tube.

41. The system of claim 40, wherein said sealing means includes a distal surface formed at the muzzle end of said outer tube configured to flushly contact a sealing surface of said blast deflector.

42. The system of claim 41, wherein said distal surface is formed to extend rearwardly toward said breech end.

43. The system of claim 42, wherein said distal surface extends rearwardly toward said breech end at an angle from the central passage from about 45 degrees to about 70 degrees.

44. The system of claim 41, wherein said attaching means includes first thread structure formed at the muzzle end of said inner tube and coacting second thread structure formed in said blast deflector for threaded engagement there between.

45. The system of claim 40, wherein said sealing means includes an O-ring seal between said outer tube and said blast deflector.

46. The system of claim 40, wherein there are six transverse channels each of which extends rearwardly at an angle from about 50 degrees to about 70 degrees as measured from the axis of said central passage.

47. For transmitting a projectile, a barrel system comprising:

a barrel having a breech end for connecting to the breech of a firearm and to receive a projectile therefrom, said barrel having a muzzle end for discharging said projectile with a bore formed for the transmission of said projectile from said breech end to said muzzle end, said barrel including:

an inner tube with a muzzle end and with a longitudinal axis and a wall defining said bore, said inner tube having an aperture formed in said wall proximate to and spaced inwardly from said muzzle end, and an outer tube with a muzzle end and positioned over said inner tube and proximate the muzzle end of said inner tube to form a chamber in fluid communication with said aperture in said wall to receive propellant therefrom, said aperture being positioned in said wall to receive said propellant after said projectile achieves substantially the exit velocity and to supply said propellant to said barrel from said chamber a blast deflector for connection to the muzzle end of said barrel, said blast deflector having an attachment end for attaching to said muzzle end of said barrel and a distal end with a central passage therein between;

attaching means for attaching said blast deflector to said barrel, said attaching means being configured to associate with both said muzzle end of said inner tube and the muzzle end of said outer tube; and sealing means for effecting a sealing connection between the outer tube and the inner tube, said sealing means including an O-ring seal between said outer tube and said blast deflector.

48. For transmitting a projectile, a barrel system comprising:

a barrel having a breech end for connecting to the breech of a firearm and to receive a projectile therefrom, said barrel having a muzzle end for discharging said projectile with a bore formed for the transmission of said projectile from said breech end to said muzzle end, said barrel including:

an inner tube with a muzzle end and with a longitudinal axis and a wall defining said bore, said inner tube having an aperture formed in said wall proximate to and spaced inwardly from said muzzle end, and an outer tube with a muzzle end and positioned over said inner tube and proximate the muzzle end of said inner tube to form a chamber in fluid communication with said aperture in said wall to receive propellant therefrom, said aperture being positioned in said wall to receive said propellant after said projectile achieves substantially the exit velocity and to supply said propellant to said barrel from said chamber a blast deflector for connection to the muzzle end of said barrel, said blast deflector having an attachment end for attaching to said muzzle end of said barrel and a distal end with a central passage therein between, said blast deflector including six transverse channels each of which extends rearwardly at an angle from about 50 degrees to about 70 degrees as measured from the axis of said bore;

attaching means for attaching said blast deflector to said barrel, said attaching means being configured to associate with both said muzzle end of said inner tube and the muzzle end of said outer tube; and sealing means for effecting a sealing connection between the outer tube and the inner tube.

* * * * *